United States Patent [19]

Bachman

[11] Patent Number: 4,913,421

[45] Date of Patent: Apr. 3, 1990

[54] HAND HELD EXERCISE APPARATUS

[76] Inventor: Alan B. Bachman, 59 Richard Sweet Dr., Woodbridge, Conn. 06525

[21] Appl. No.: 292,835

[22] Filed: Jan. 3, 1989

[51] Int. Cl.[4] ..... A63B 21/00

[52] U.S. Cl. ..... 272/117; 272/67; 272/119; 272/122

[58] Field of Search ..... 272/67, 116, 117, 119, 272/122, 123, 139, 143

[56] References Cited

U.S. PATENT DOCUMENTS

| | | | |
|---|---|---|---|
| 3,180,641 | 4/1965 | Shane | 272/119 |
| 4,109,908 | 8/1978 | Pugh et al. | 272/119 |
| 4,345,756 | 8/1982 | Hoagland | 272/117 |
| 4,484,740 | 11/1984 | Green | 272/119 |
| 4,537,394 | 8/1985 | Golinsky, Jr. | 272/117 |
| 4,607,840 | 8/1986 | Harper | 272/117 |
| 4,641,836 | 2/1987 | Clifton | 272/117 X |
| 4,720,096 | 1/1988 | Rogers | 272/117 |
| 4,830,361 | 5/1989 | Hoffman | 272/122 X |

*Primary Examiner*—Robert W. Bahr

*Attorney, Agent, or Firm*—Bachman & LaPointe

[57] ABSTRACT

A hand held exercise apparatus including a tubular attachment device, arm engagement device affixed thereto, a hand grip affixed thereto and a first weight supporting device carried by said tubular attachment device adapted for supporting a variety of exercise weights.

11 Claims, 1 Drawing Sheet

HAND HELD EXERCISE APPARATUS

BACKGROUND OF THE INVENTION

The present invention relates to physical fitness and particularly to a hand held exercise device which is versatile and which increases the range of resistance on the muscles.

Conventionally hand held exercise devices of the bar bell type are characterized by a tubular attachment means and weight supporting means on either end thereof. Although these devices are capable of use in a variety of exercises their range of resistance on the muscles is limited. Naturally, it is highly desirable to increase the range of resistance on the muscles since this represents a more efficient exercise mechanism with greater versatility.

Moreover, it is desirable to provide a hand held exercise device which is capable of a greater strengthening effect on the muscles. It is desirable to provide a hand held exercise device which provides resistance on the muscles through as wide a range of movement as possible.

SUMMARY OF THE INVENTION

In accordance with the present invention it has now been found that the foregoing objects and advantages can be readily obtained. The present invention comprises a hand held exercise device including: tubular attachment means having a first and second end portion; arm engagement means affixed to said tubular attachment means operative to restrain the arm in a position substantially parallel to the tubular attachment means; a hand grip affixed to the tubular attachment means adjacent the first end portion; and a first weight supporting means carried adjacent a second end portion of the tubular attachment means adapted for supporting at least one exercise weight, preferably a variety of exercise weights and preferably with the first weight supporting means carried parallel or at an angle to the tubular attachment means as an extension thereof.

In a preferred embodiment a second weight supporting means is carried by the tubular attachment means intermediate the first and second end portions preferably perpendicular to the tubular attachment means, adapted for supporting at least one exercise weight.

In a further preferred embodiment at least one of said first and second weight supporting means are removable from the tubular attachment means wherein the tubular attachment means includes means for carrying a weight supporting means adjacent said first end portion at an angle with respect to the tubular attachment means.

The arm engagement means is preferably an arm strap adapted to encircle the arm, generally padded with an adjustable buckle. The hand grip preferably includes a hand guard adjacent the hand grip.

Further objects and advantages of the present invention will appear hereinbelow.

BRIEF DESCRIPTION OF THE DRAWINGS

Other features and advantages of the present invention will be more apparent from an examination of the succeeding specification when read in conjunction with the appended drawings, in which.

DETAILED DESCRIPTION

Figure 1:
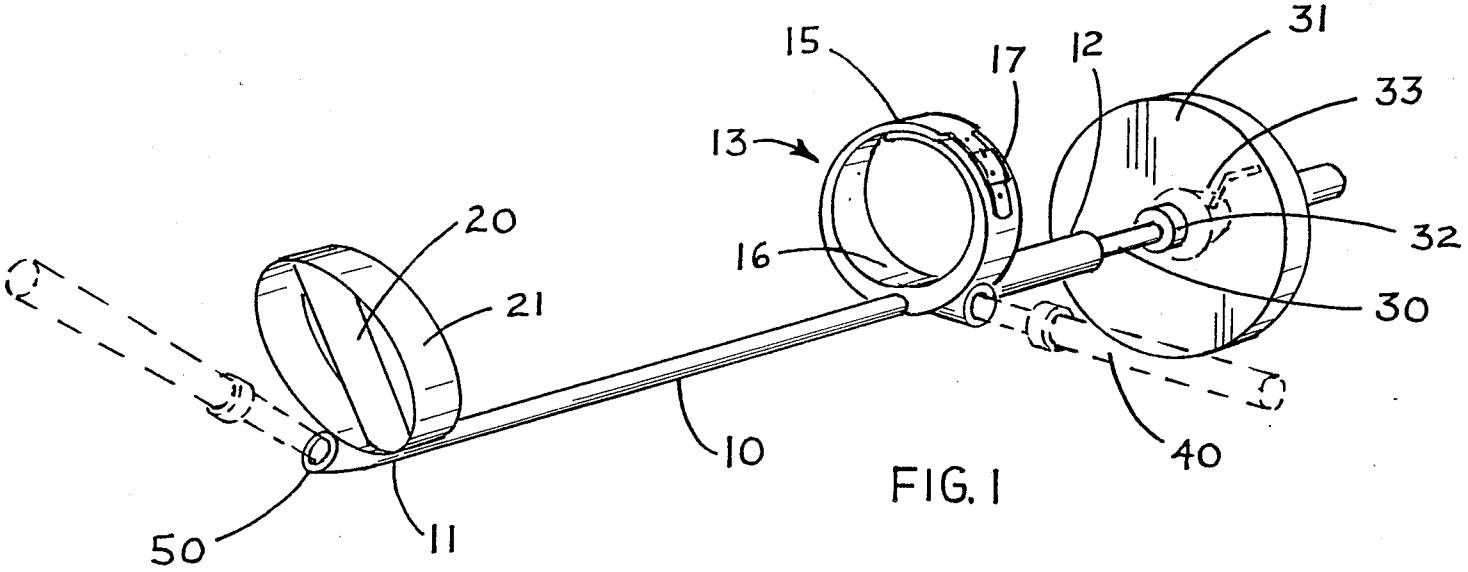
FIG. 1 is a perspective view of the exercise device of the present invention.

Referring now in detail to the drawings, tubular attachment means 10 is shown having a first end portion 11 and a second end portion 12 and arm engagement means 13 affixed thereto intermediate the first and second end portions operative to restrain an arm in a position substantially parallel to the tubular attachment means 10. The arm engagement means 13 is an arm strap 15 adapted to encircle the arm for firm engagement and restraint, preferably including padding 16 and buckle 17 for a comfortable fit and easy access, respectively.

Hand grip 20 is affixed to the tubular attachment means 10 adjacent the first end portion 11 for easy grasping by the hand of the arm restrained by the arm engagement means 13. Hand guard 21 is preferably provided adjacent the hand grip to protect the hand especially if two of the exercise apparatuses of the present invention are used in overlapping relationship.

Figure 2:
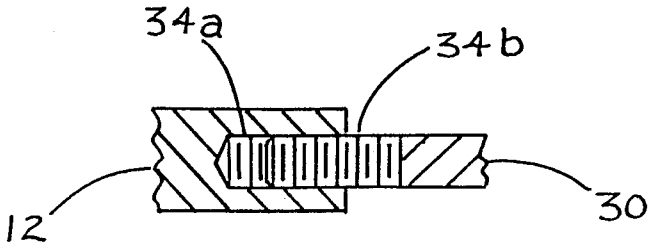
FIG. 2 is a detailed view of the means on the tubular attachment means for carrying the weight supporting means.

A first weight supporting means 30 is carried by the tubular attachment means 10 at the second end portion thereof adapted for supporting at least one exercise weight 31. As shown in FIG. 1, the first weight supporting means is substantially parallel to the attachment means 10; however, it may desirably be carried at an acute angle with respect thereto, as for example less than 60°. Conventional weight stop 32 and weight securing means 33 are provided to maintain the weight or weights in a fixed position and to provide easy means for placing and removing the weight or weights on and from the weight supporting means. Naturally a plurality of weights can readily be used depending on the weight load desired. First weight supporting means 30 is removably carried on tubular attachment means 10 by any desired means to provide a firm engagement, as by screw-threaded engagement shown in FIG. 2 with mating screw threads **34*a* and 34*b* on the tubular engagement means 10 and first weight supporting means 30**, respectively. Naturally, other conventional means may readily be used to maintain the weights on the tubular attachment means.

A second weight supporting means 40 (shown in phantom) may be carried by the tubular attachment means 10 at an angle thereto intermediate the first and second end portions preferably thereof substantially perpendicular thereto. The second weight supporting means 40 is substantially the same as the first weight supporting means 30 adapted for supporting at least one exercise weight and with weight stop and weight securing means thereon as with the first weight supporting means. If desired, the second weight supporting means may be removable in the same manner as the first weight supporting means.

Means 50 are provided for carrying a weight supporting means adjacent the first end portion 11 thereof at an acute angle thereto as shown in dotted lines on FIG. 1, having screw threads so as to be compatible with the first and/or second weight supporting means. Therefore, either the first or second weight supporting means may be placed on carrying means 50 providing for considerable versatility for the device of the present invention.

The exercise device of the present invention achieves significant advantages. The device is extremely versatile and usable in a variety of exercises. Generally, two exercise devices are employed one in each hand and arm, although only one may be used if desired. The exercise device is particularly usable in flye type exercising. For example, one exercise device can be held in each hand and arm and cross over type exercises employed to strengthen the chest or pectoral muscles. The exercise device or devices may be used in conjunction with a bench type exercise device where the individual is positioned on the bench lifting the exercise device or devices, for example, lying on one's back. One could utilize the exercise device standing, lifting the arms holding the device or devices over one's head to strengthen the deltoid muscles.

The versatility of the exercise device of the present invention is improved by the placement of the weight supporting means. For example, if second weight supporting means 40 is carried by the tubular attachment means 10 intermediate the first and second end portions thereof, naturally with weights thereon and without weights on the first weight supporting means, lifting the arm while bending the elbow provides considerable muscle strengthening on different portions of the muscle normally improved with this type of exercise. When a weight supporting means are provided on carrying means 50, one can for example lie sideways on a bench type exercise device and lift the arm in a backward flye motion. This improves the rear deltoid muscles with a single exercise device.

The presence of different oriented weight supporting means and the general configuration of the device of the present invention allows greater versatility in exercising with an increased range of resistance on the muscles due to the versatility of positioning of the weights on the unit. In addition, the device of the present invention enables an increased range of resistance due to the relationship of the weights and the pivoting of the joints of the arm in association therewith. The device of the present invention uses the principle of the weight cantilevered away from the center line of the arm and shoulder joint to increase the range of pull on the arm due to gravity. One desires resistance on the muscles through as much of the range of movement of the arm as possible. With the unit of the present invention, one obtains resistance through a greater range of movement than with conventional devices. The weight supporting means in a variety of orientations as described herein, enables one to hold the weight in a variety of spaced relationships with respect to the arm. For example, the angle relationships aid in the cantilever effect.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hand held exercise apparatus which comprises: tubular attachment means having a first and second end portion; arm engagement means affixed to said tubular attachment means operative to restrain the arm in a position substantially parallel to the tubular attachment means; a hand grip affixed to the tubular attachment means adjacent the first end portion; and a weight supporting means on at least one of said first and second end portions of the tubular attachment means carried at an acute angle of less than 60° with respect to said tubular attachment means adapted for supporting at least one exercise weight, wherein said weight supporting means is located on the same side of the tubular attachment means as the arm engagement means.

2. An apparatus according to claim 1 wherein the first weight supporting means is carried at the second end portion as an extension thereof and wherein said arm engagement means is operative to restrain the arm above the tubular attachment means.

3. An apparatus according to claim 1 wherein said arm engagement means is an arm strap operative to encircle the arm.

4. An apparatus according to claim 3 wherein said arm engagement means is padded.

5. An apparatus according to claim 4 wherein said arm engagement means includes an adjustable buckle.

6. An apparatus according to claim 1 including a hand guard adjacent the hand grip.

7. A hand held exercise apparatus which comprises: tubular attachment means having a first and second end portion; arm engagement means affixed to said tubular attachment means operative to restrain the arm in a position substantially parallel to the tubular attachment means; a hand grip affixed to the tubular attachment means adjacent the first end portion; and a first weight supporting means at the second end portions of the tubular attachment means adapted for supporting at least one exercise weight wherein the first weight supporting means is carried parallel to the tubular attachment means as an extension thereof.

8. A hand held exercise apparatus which comprises: tubular attachment means having a first and second end portion; arm engagement means affixed to said tubular attachment means operative to restrain the arm in a position substantially parallel to the tubular attachment means; a hand grip affixed to the tubular attachment means adjacent the first end portion; and a first weight supporting means at the second end portions of the tubular attachment means adapted for supporting at least one exercise weight, including a second weight supporting means carried by the tubular attachment means intermediate the first and second end portions thereof adapted for supporting at least one exercise weight.

9. An apparatus according to claim 8 wherein the second weight supporting means is substantially perpendicular to the tubular attachment means.

10. An apparatus according to claim 8 wherein at least one of the first and second weight supporting means are removable from the tubular attachment means.

11. An apparatus according to claim 10 wherein said tubular attachment means includes means for carrying a weight supporting means at the first end portion thereof and at an angle with respect to the tubular attachment means.

* * * * *